US005699627A

United States Patent [19]

Castro

[11] Patent Number: 5,699,627

[45] Date of Patent: Dec. 23, 1997

[54] INTEGRAL SYSTEM FOR THE MANUFACTURE OF CUSHIONED SHOES

[76] Inventor: Ramon Salcido Castro, Circunvalación No. 101, Dpto. 13, Col. Cd., Granja Zapopan, Jal., Mexico

[21] Appl. No.: 346,415

[22] Filed: Nov. 29, 1994

[51] Int. Cl.[6] ..... A43B 7/00; A43B 13/18; A43B 21/26

[52] U.S. Cl. ..... 36/28; 36/3 B; 36/35 R

[58] Field of Search ..... 36/3 B, 25 R, 36/31, 35 R, 34 B, 76 R, 76 C, 34 R, 34 A, 28

[56] References Cited

U.S. PATENT DOCUMENTS

| | | | |
|---|---|---|---|
| 2,105,647 | 1/1938 | Gutwein | 36/3 B |
| 2,153,021 | 4/1939 | Margolin | 36/3 B |
| 2,383,515 | 8/1945 | Sabo | 36/34 B X |
| 2,644,250 | 7/1953 | Ciaio | 36/76 C |
| 2,807,100 | 9/1957 | Windle | 36/35 R |
| 3,216,133 | 11/1965 | Houle | 36/34 R |
| 3,822,709 | 7/1974 | Gruner | 36/34 R X |
| 4,624,061 | 11/1986 | Wezel et al. | 36/31 X |
| 4,658,516 | 4/1987 | Beck | 36/31 X |
| 4,729,178 | 3/1988 | Boucher | 36/34 R X |
| 5,325,612 | 7/1994 | Lock et al. | 36/34 R |
| 5,435,078 | 7/1995 | Pyle | 36/31 X |
| 5,467,536 | 11/1995 | Ramer et al. | 36/31 B X |

*Primary Examiner*—B. Dayoan
*Attorney, Agent, or Firm*—Ladas & Parry

[57] ABSTRACT

Components for the manufacture of a shoe include a shoemaker's last, a padded sole member, an insole assembly, an antiskid damping sole and a heel assembly. These components may be used together or combinations thereof may be used in the manufacture of shoes for women, men or children.

21 Claims, 8 Drawing Sheets

FIG-8
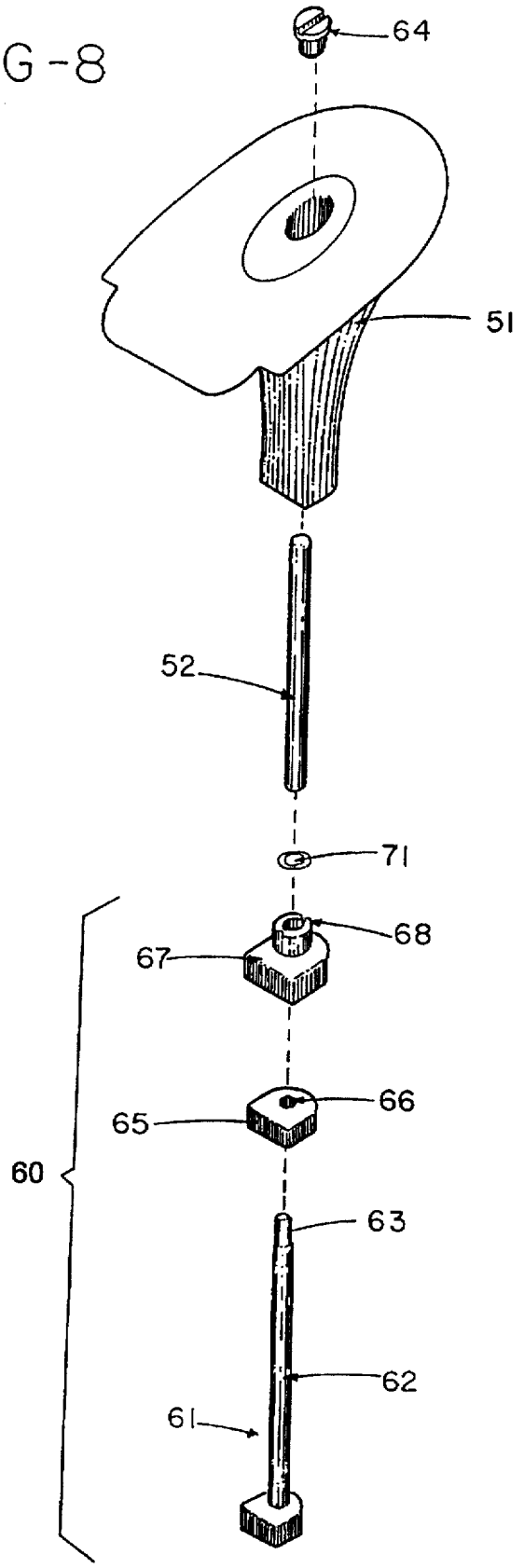
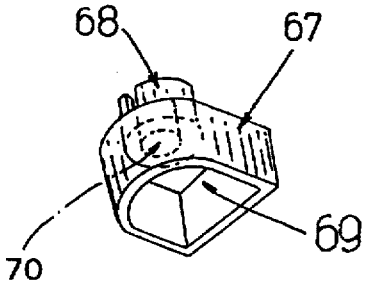
FIG-8A

INTEGRAL SYSTEM FOR THE MANUFACTURE OF CUSHIONED SHOES

BACKGROUND OF THE INVENTION

1. Field of the Invention

The invention relates to a shoe, and particularly to an integral system for the conformation of a heeled shoe for women. The system of the invention is also applicable to the manufacture of men's and children's shoes and shoes of different designs (sport, casual, etc.). The system of the invention provides for impact absorption characteristics on the plantar and tarsal zones of the wearer when walking, and provides for foot sole ventilation to give comfort to the wearer of the shoe.

2. Description of the Prior Art

Many different proposals have been made with the purpose of producing a new shoe that without prejudice of the aesthetics offers comfort and security to the wearer. Regarding the comfort aspect, different ways have been suggested to reduce to the utmost the hit or impact of the foot when walking, including different means to pad the foot's sole. However, said padding means consist of simple insoles with padding characteristics to lessen the impact when walking. The materials have a short useful life because of their limited elastic properties.

The prior art proposals for ladies shoes are limited to the incorporation of a cushioning insole to lessen the shock when walking. This insole is mostly essentially flat, and is made of material with low damping capacity. Such proposals are clearly limited to solve partially, in a minimum way, the real lack of comfort for the wearer of high heeled shoes, until now nothing as a whole is known to offer innovations to create a truly comfortable shoe, which includes all of the structural parts of the shoe.

Although separation or breaking up of the heel is one of the most frequent problems in the use of high heeled shoes for ladies the applicant does not know the existence of systems designed to grasp in a firm and safe way the shoe's heel. In some cases, as in the U.S. Pat. No. 4,819,344, the improvement consists of a device integrated to the heel of the shoe, including a hole of a certain length in which is inserted an expansive piece that holds the cap of the heel so as to fix it firmly to said heel. Obviously, this proposal is not related in any way with the solution to the problem of avoiding the breakage or separation of the shoe's heel, nor suggests damping means in the heel to dampen its impact on the floor when walking.

SUMMARY OF THE INVENTION

The main objective of the invention consists of an integral system for the manufacture of heeled shoes for women or men made of elements designed to bring comfort to the wearer while maintaining the aesthetics of the traditional shoe.

The above objective is reached with an integral system formed by damping elements to lessen the impact on the foot's sole when walking, each element being designed to fulfill individually its own function and interact with the other elements in an integrated system, which allows the comfortable use of high healed shoes, even for long journeys.

The above objectives and some others are fulfilled by manufacturing a women's shoe which includes an anatomically conformed insole of elastomeric material, which incorporates a ventilation system for the sole of the foot based on a plurality of through holes distributed on the insole surface and some channels on the lower surface of said insole, said channels being in air flow communication with said holes to create together an air flow effect below the user's foot. The insole rests on a sole assembly formed by several superposed elements designed to accommodate properly the elastomeric insole.

Immediately below the sole assembly, a damping and antiskid sole is disposed, which is made of elements able to absorb the force of impact on the sole zone when walking and means to avoid skids on wet and smooth floors. The design of the sole and, the sole and insole assembly has been carefully developed in order that the integration of these elements do not harm the aesthetic appearance of the typical shoe for a woman. Of course, the same concept is applicable for making shoes for men and children.

The system of this invention is completed by a new model of heel conformed to fulfill the safety requirements by incorporating a structural reinforcement and to provide comfort by including an impact damping assembly in the heel zone.

It will be evident that the foregoing integral system can be used not only for making women' shoes but also for making men and children' shoes.

DESCRIPTION OF THE DRAWINGS

FIG. 8, is an exploded view of the shoe heel showing the elements thereof;

FIG. 8A is a bottom perspective view of the protection cap forming part of the assembly shown in FIG. 8.

DETAILED DESCRIPTION OF THE PREFERRED EMBODIMENT OF THE INVENTION

Although the description and drawings refer to the manufacture of women's shoes, it should be understood that most of the different aspects of the integral system to be described hereinafter can apply also to the manufacture of different designs of shoes for men and children. Accordingly, it is intended that the following description is taken only by the way of example.

Figure 1:
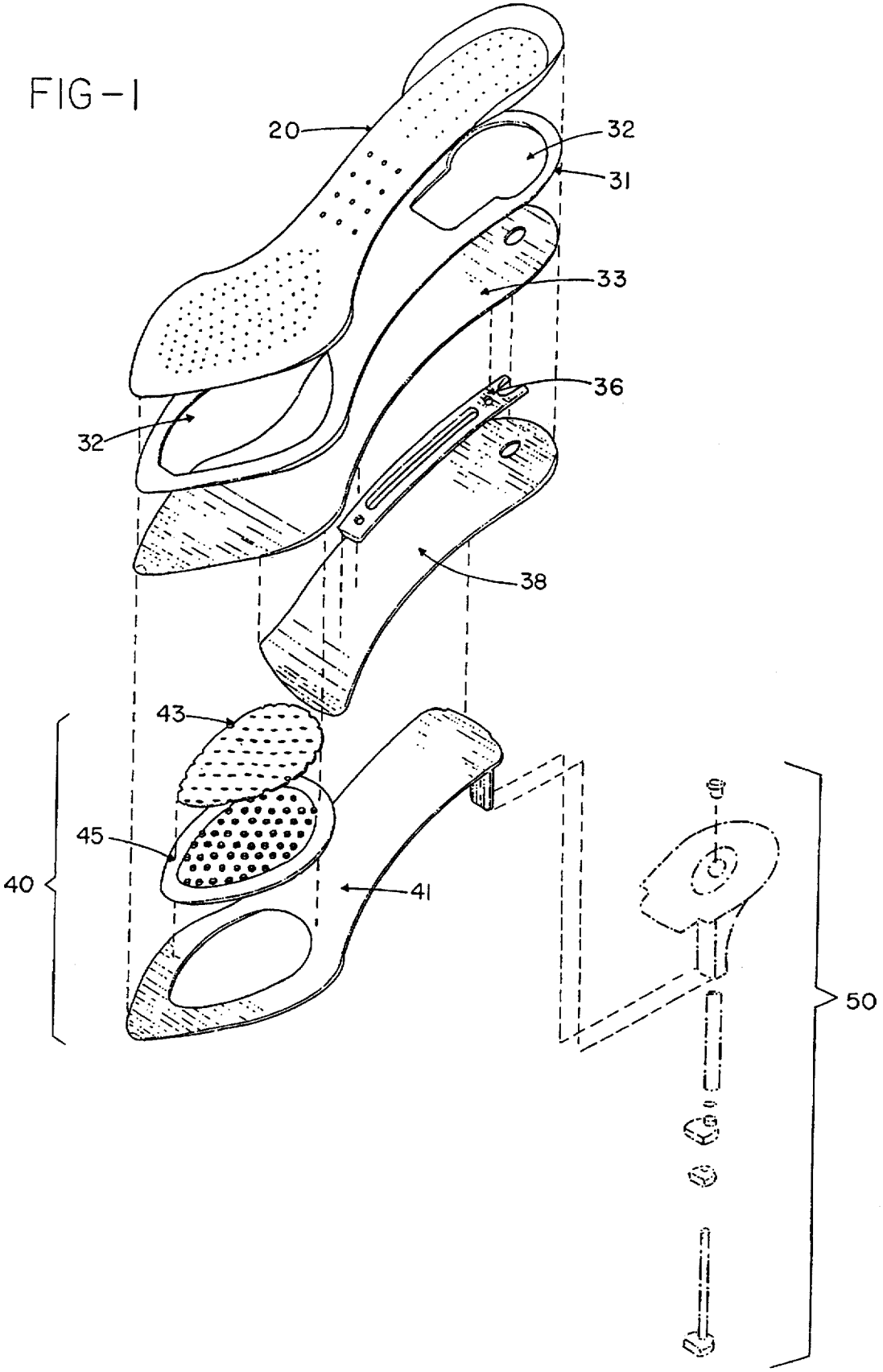
FIG. 1, is a perspective and exploded view of the integral system for the manufacture, in the example shown in this figure, of heeled shoes for ladies, in which the disposition of the different elements of said system can be observed.
Figure 2:
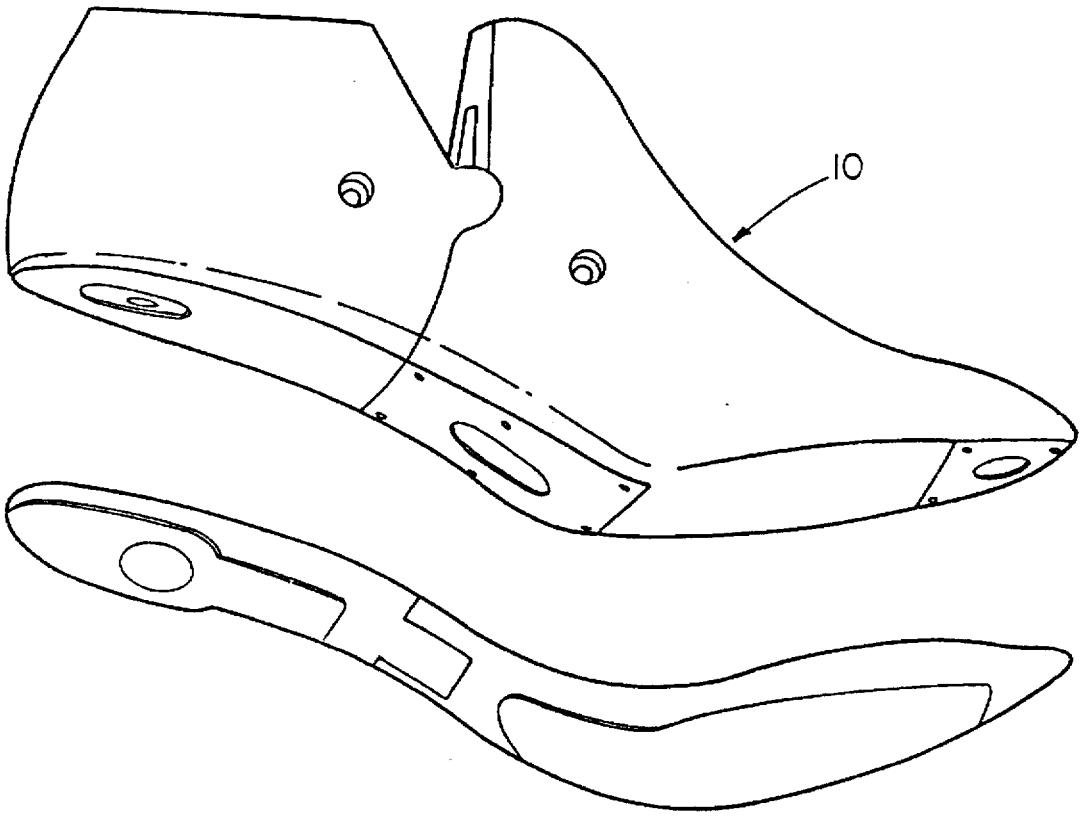
FIG. 2, is a perspective view of a model of a shoemaker's last for the new shoe of the invention.
Figure 3:
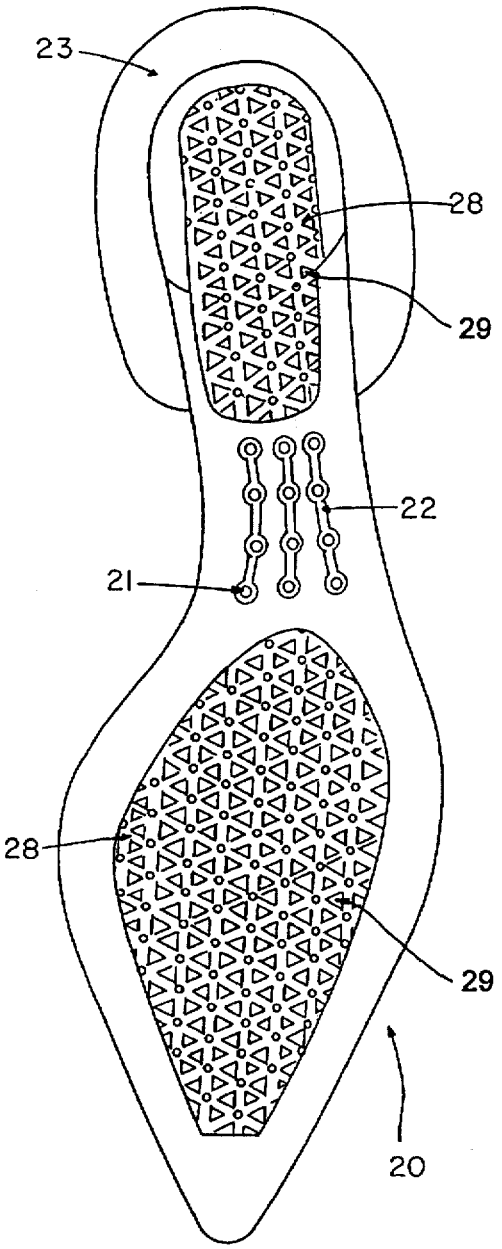
FIG. 3, is a top view of the lower surface of the elastomeric insole according to the present invention.
Figure 4:
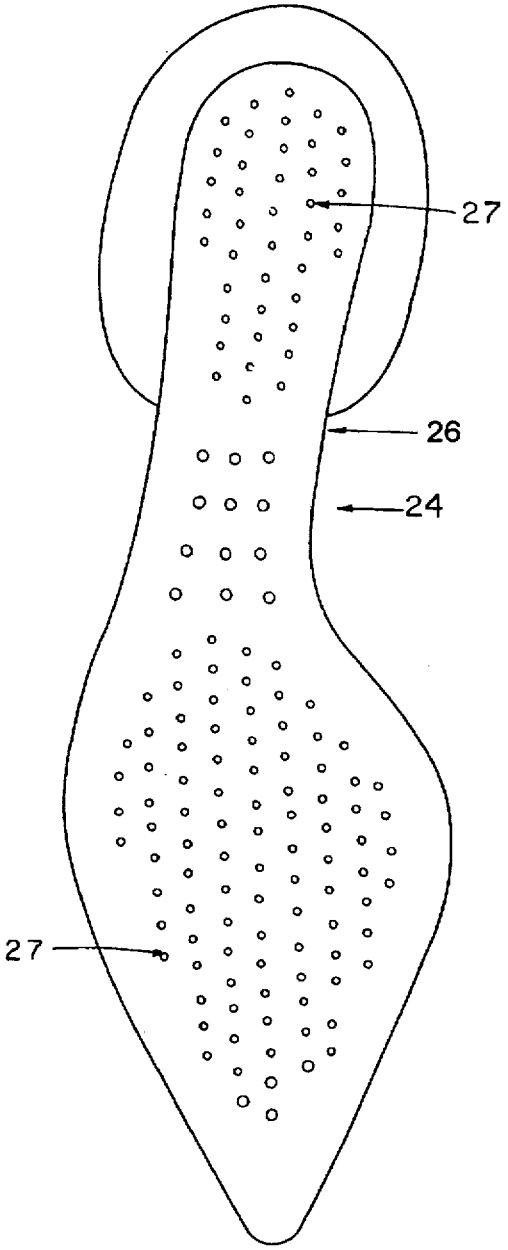
FIG. 4, is a top view of the upper surface of the same insole shown in preceding figure.
Figure 6:
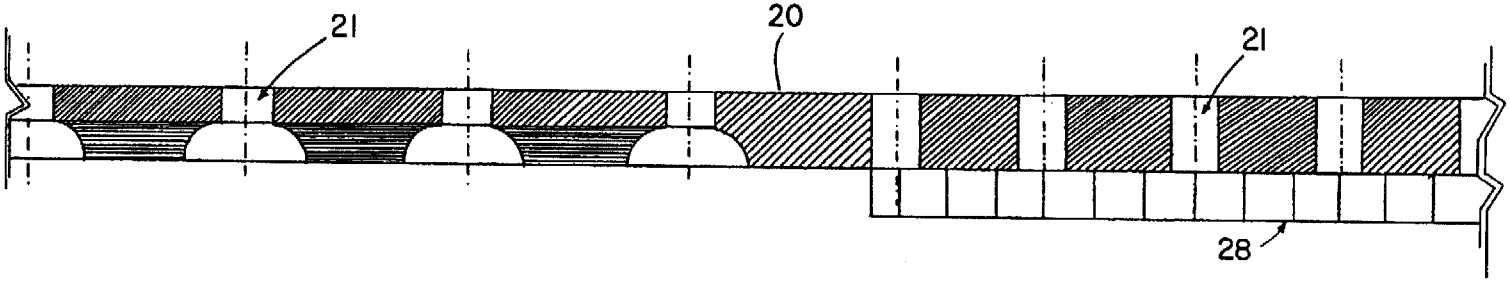
FIG. 6, is a side view of said elastomeric insole.
Figure 5:
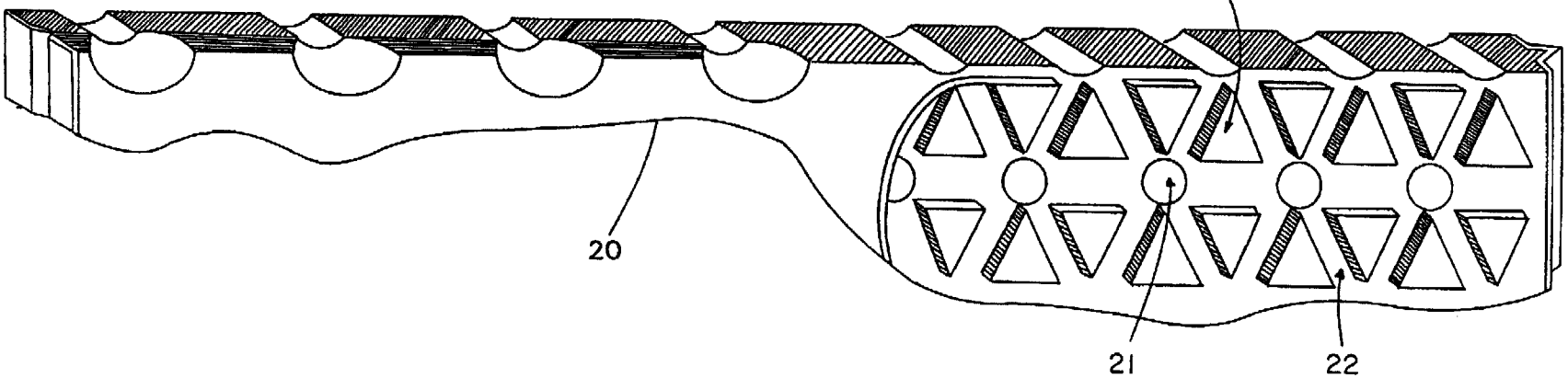
FIG. 5, is an enlarged view of a portion of the insole lower surface.

The invention relates to an integral system (FIG. 1 ) for the conformation of shoes for women, men and children, said system being integrated by several structural parts, each destined to give comfort and safety to the wearer of the shoe.

According to the specific embodiment shown in the drawings, the system comprises the following basic elements: 1) a last 10 for shoes to give form thereto according to the foot's basic anatomic characteristics; b) an insole 20 of elastomeric material to absorb the common impacts suffered by the foot on all zones of the foot's sole and having means to create a ventilation system for the foot's sole to eliminate the excessive sweat of the foot; c) a sole assembly 30 for shoes placed immediately under the padded insole, with which is adjusted for its insertion, which regulates the different thicknesses and heights of said elastomeric insole for its maximum stability and perfect insertion and also allows for the shift of the different contact areas and load so that these find an appropriate place of support and consequently the impact when walking is lessened; d) a dampening and antiskid sole 40, placed under the sole assembly for the shoe, which helps to lessen the impact on the foot when walking and lessens the risk of skids on wet and smooth floors; and e) a heel that includes absorbing means to dampen on this zone the impact of the step when walking, based on the "cause-effect" theory.

The last 10 is characterized by the exact anatomic tridimensional and the baricentric axis, and has an anatomic surface complementary on the plantar zone, and is specially created to give room to the insole 20.

Insole 20, consists of an element made of a single piece of elastomeric material with a ventilation system that creates a continuous air flow of the same thermic air that surrounds the foot's sole and the zones in contact with the floor. The system includes some ventilation means on the insole consisting in multiple holes 21 that go through the insole in the plantar, tarsal and metatarsal regions, and a plurality of channels 22 limited on the inferior surface of the insole by multiple triangular forms 29 distributed in thickened sections 28, said channels in communication of air flow with the holes 21, in a way that establish paths for air circulation on the whole sole of the foot.

Because of the special design of insole 20, as shown in FIGS. 3–6, the air flowing in the foot's sole is pumped at each step of the user, by the action of the body's weight applied on the sole, expelling the air at the time of contact with the floor, by said through holes 21 and channels 22. In this manner, small bursts of air are expelled, repeatedly when the foot detaches from the floor to do a step, creating at the same time an effect of absorption of the same air within the contact zone, making it circulate on the foot's sole and at each step made when walking.

The insole 20 has been developed to be manufactured at different densities and thicknesses according to the needs of the foot's sole. This characteristic produces a stabilizing effect at the time in which the foot rests on a surface adapting itself to the form of said foot and supporting it within a created concave surface, giving to the wearer of the shoe a feeling of greater comfort when walking and a stabilizing effect because it also embraces the heel's area with a flange 23 included in the insole in this zone.

Adhered to the upper surface of the elastomeric insole 20, there is an overinsole 24 that is in direct contact with the foot's sole. Said overinsole was conceived to include an antibacterial lining 25 to avoid fungus formation and includes some copper biomagnetic sensors 26 aimed to control the overheating of the foot muscles and ligaments in order to reduce to a minimum the amount of magnetic energy accumulated because of the overheating effect, which causes mood changes, physical fatigue and excessive sweating of the feet. Besides, the oversole 24 also includes a ventilation system consisting of multiple minute holes 27 being in airflow communication with the insole holes 21.

Figure 7:
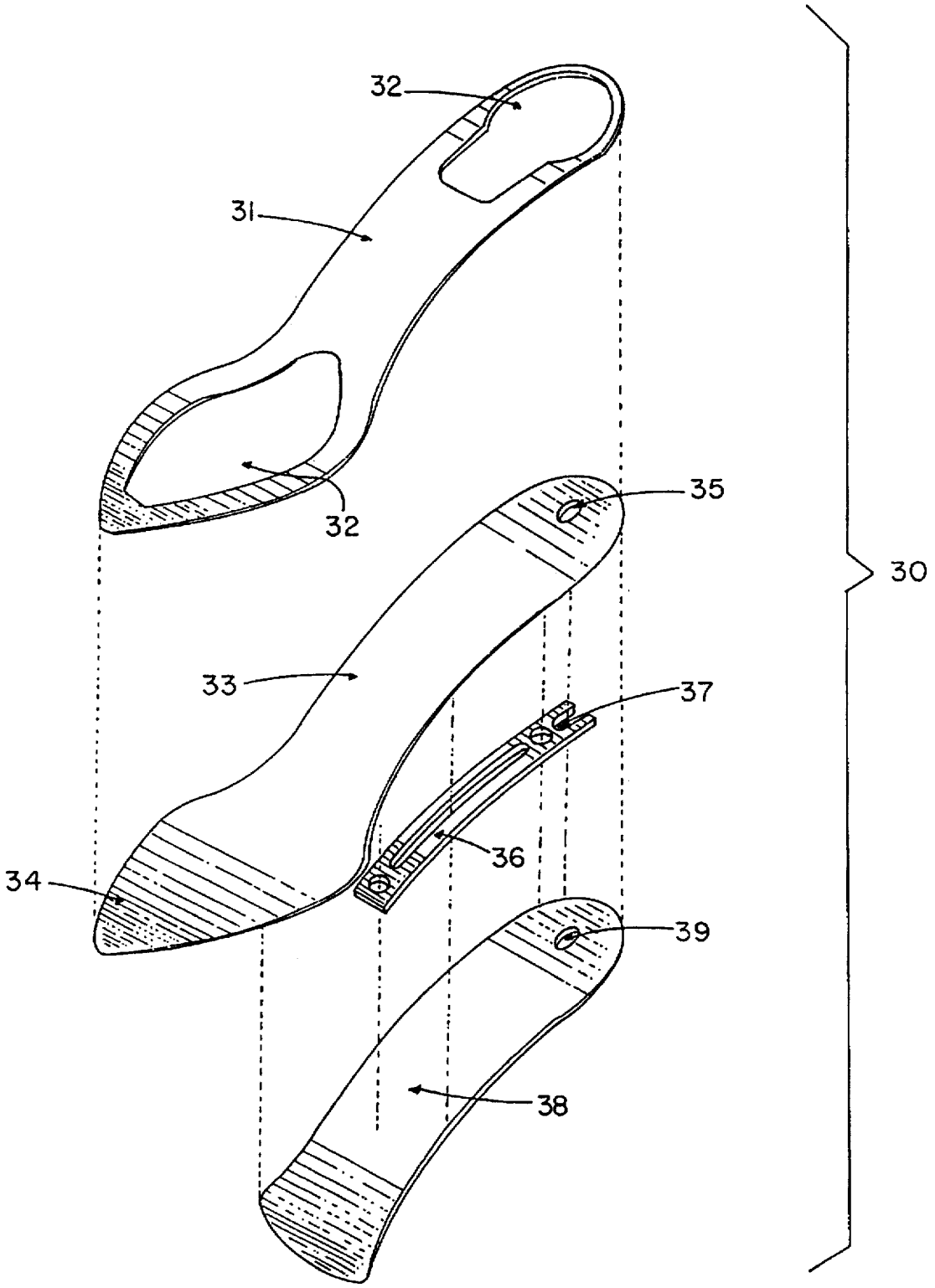
FIG. 7, is an exploded view of the sole assembly of said system according to the present invention.
Figure 10:
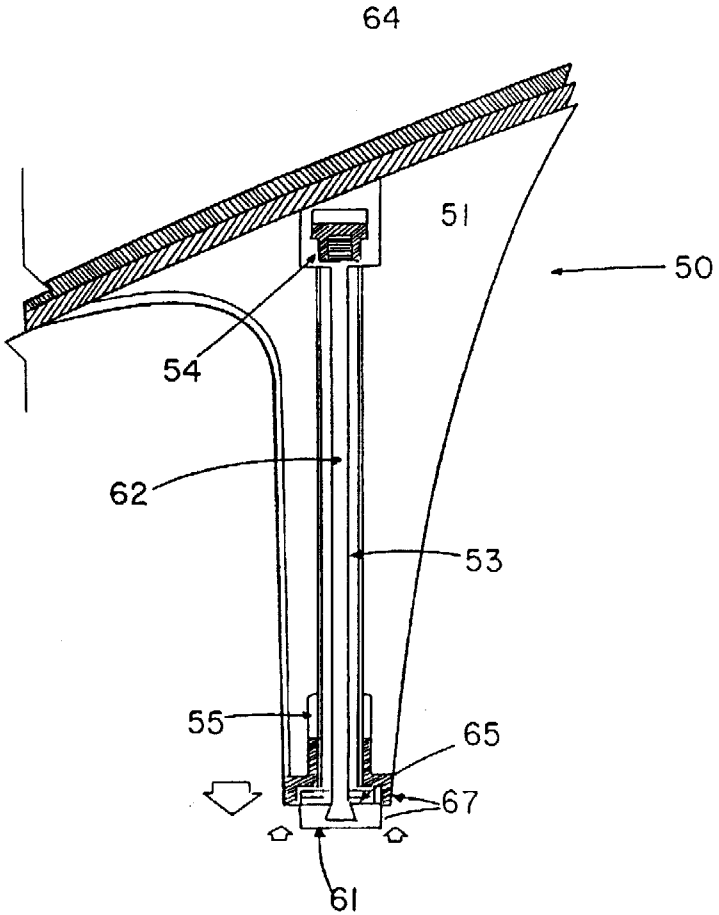
FIGS. 9 and 10, are sectional views of the assembled heel, in which the heel is shown without load (FIG. 9) and how it behaves under load (FIG. 10)
Figure 9:
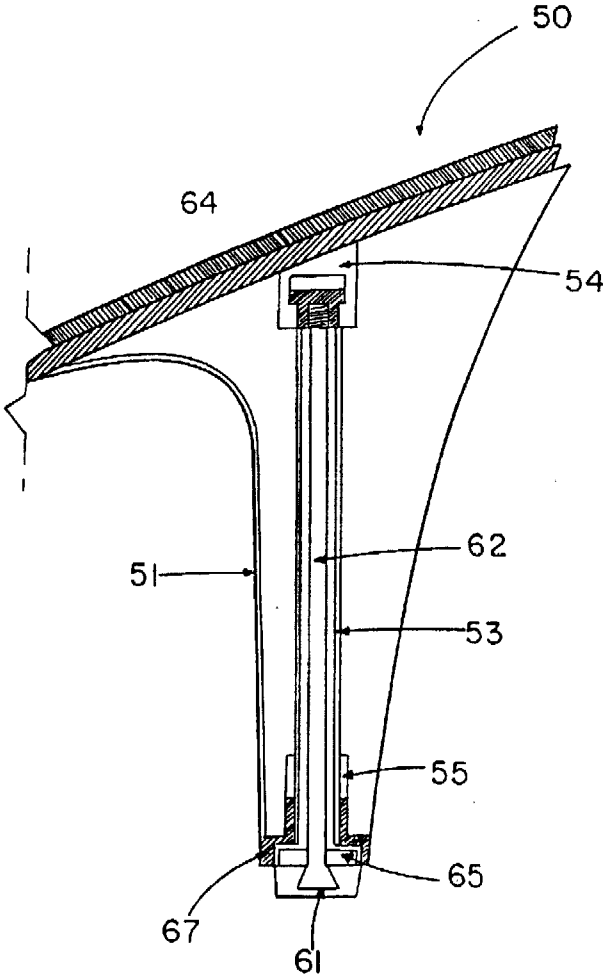

Referring to FIG. 7, the sole assembly 30 for shoes, achieves, because of its functional technical design, the following objectives: a) to provide a place for the airbiomagnetic insole 20; b) to facilitate the movement of the different contact and charge areas exerted by the foot when walking; c) to diminish the resistance to the flexion when taking a step; d) to improve the anatomic structure of the foot's sole; and e) to allow and facilitate the building and interchange of the cap element with the rod and screw of the damping cap assembly, discussed below, by the wearer.

To achieve the foregoing objectives, the sole assembly 30 includes the following parts: a baricentric oversole 31 with hollow sections predefined 32 on the plantar and tarsal regions, in which are inserted the lower thickened parts 28, of matching design of the padded insole 20; an intersole 33, placed under the oversole 31 provided with flexure lines 34, consisting of fine cut lines just on the area below where the foot bends when making a step, said intersole 33 further includs a hole 35 that allows for fixing the soles during installation, the intersole outline is appropriately anatomic; a metatarsal leather strip 36 with a dented end 37 placed under the intersole 33 to provide rigidity and structure (in support) to the arch and/or metatarsal bridge, which in relation with the walking mechanics helps the optimal distribution and balancing of weights and charges exerted on the baricentric axis and the formed anatomic structures; and finally a reinforcing core 38 planned according to the same anatomic principles of the other parts of the sole assembly 30 whose function is to reinforce structurally the parts of said assembly when they are assembled. Hole 39 is a hole whose purpose is to fix the rod 62.

Regarding the heel 50 of the shoe, its structure represents another of the integral systems important characteristics, as due to its design it satisfies requirements such as to allow the linking of the dampening cap assembly 60 described below, facilitate the replacement of said assembly 60, to correspond to an aesthetically defined figure, to have in consideration the heel in correct position on the base of the body baricenter in its static and dynamic state and to keep the support position of the heel with respect to the arch support and sole of the foot.

In the new system's heel 50 have been considered the dynamics and physical anatomic behavior of the foot in movement that allows determination of the function and real position of the arch support. Its proportional structure responds mainly to a functional requirement of the foot, that is, to maintain the heel in the right position and with relation to the arch support. Said heel 50 comprises two basic elements that are a heel body 51 with a structural reinforcement 52 and means 60 to dampen the step impact on this zone. The reinforcement consists of a strong tubular sheath inserted inside a bore 53 extending substantially throughout the length of heel body 51. Recesses 54,55 are provided at the ends of said bore 53 for the purposes that will be now described.

The heel dampening means consist of an assembly of dampening cap 60 designed to fulfill the following requirements: to absorb wholly the impact caused when a step is made, to eliminate the noise when walking and reduce partially the skids. The cap assembly 60 has a removable cap element 61 with a rod firmly fixed to the cap on one of its ends. The other rod end 63 is threaded and is inserted into the longitudinal bore 53 of the heel body 51, through the lower end of the heel, said threaded end 63 protruding in recess 54 to be secured in position by a grasping element 64, such as a locknut.

Additionally, the dampening cap assembly 60 includes an elastomeric capsule or piece 65 adapted to absorb the impact caused with the heel when walking, said piece has a hole 66 through which rod 62 passes when inserted in said bore 53. In position, the elastomeric piece 65 remains in contact with the end piece of the replacement cap element 61.

Also, the assembly 60 includes a protection cap 67 fixed fittingly, or by any other appropriate means, on the lower end of the heel body 51 through the insertion of a journal 68, integrated on the face of said cap 67, in the lower groove 55 of the piece 51. The face of the protection cap 67 opposed to the face containing the journal 68 has a recess 69 with the same shape of the elastomeric piece 65 and the cap element 61; said recess 69 has a hole 70 through which is inserted the rod 62 of the cap element. In this way, when all of the heel components are assembled, the elastomeric capsule 65 remains inside the recess 69 of the protection cap and upon exerting the force of the impact in the heel when a step is made, said capsule 65 absorbs completely said impact because of its intrinsic elastic characteristics.

Finally, said dampening cap assembly 60 includes an annular gasket 71 placed between the protection cap 67 and the lower recess 55 of the heel body 51 to suppress any noise that could be produced when walking.

Figure 11:
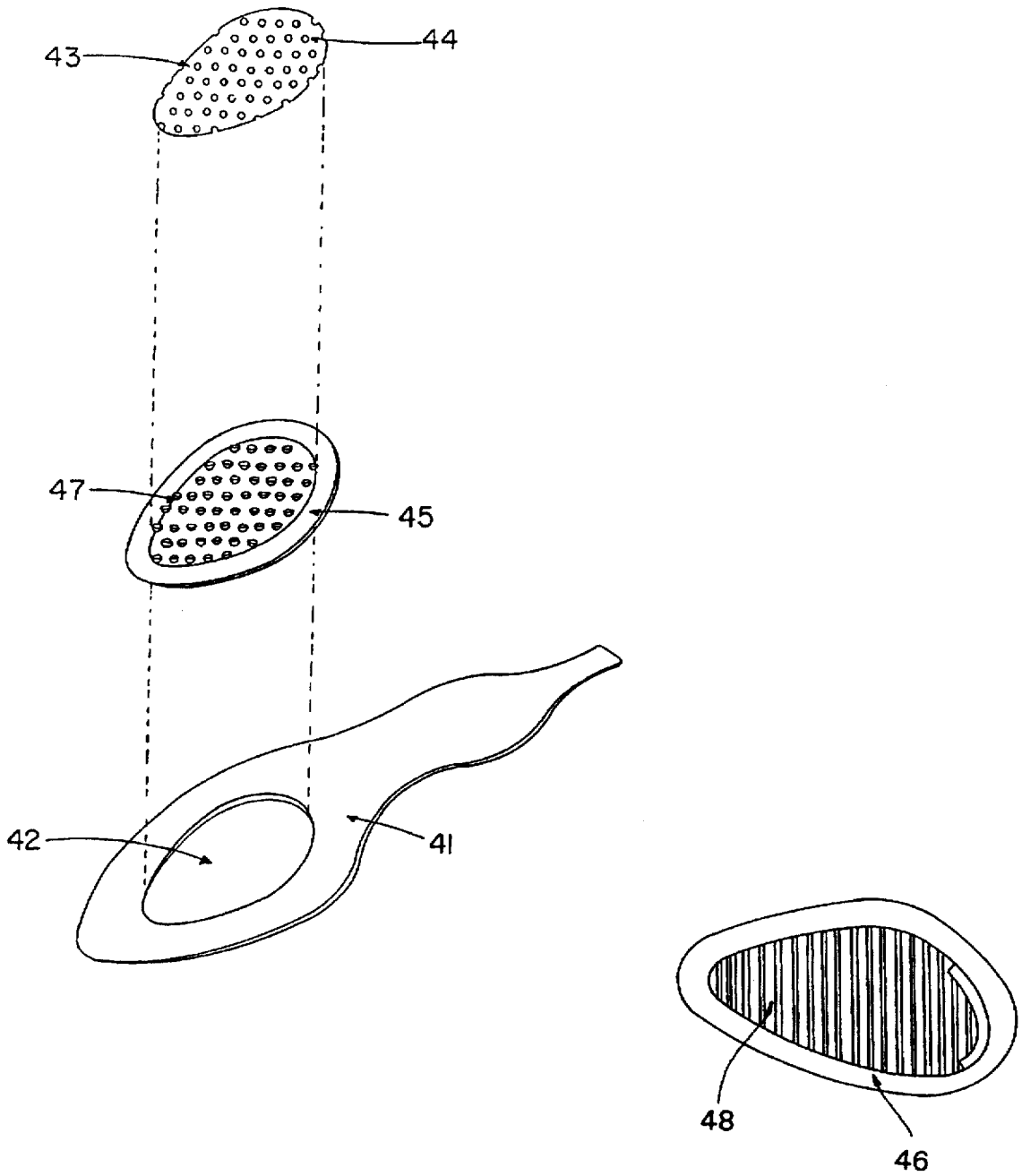
FIG. 11, is a perspective view of the elements forming the sole of the shoe.

Referring now to FIG. 11, it illustrates the components of the shoe sole 40 characterized by its impact absorption and antiskid characteristics. The sole 40 consists of a sole element 41 of any appropriate material containing a hollow section 42, an intersole element 43 of elastomeric material with multiple holes 44, and a plantar piece 45 with an antiskid lower surface 46 and an upper surface including a plurality of truncated-shaped elements 47 upwardly projecting to couple by pressure with the holes 44 of the elastomeric element 43. The elastomeric intersole 43 allows for the impact partial absorption and its adaptation to the floor irregularities, while the plantar piece 45 has in its lower face a system of relief lines 48 defining the antiskid surface 46 with which a grasping effect is obtained on any type of surface. The combination of the foregoing elements prevents skids both on wet and smooth floors and allows a partial reduction of impact in the plantar region when a step is made.

Additionally, the sole 40 described achieves the purpose of avoiding premature wearing out of the shoe, isolating the sole of the foot from thermic changes and humidity and protecting the steps.

Due to the elastomeric insole 20 characteristics, it is eventually necessary that this element may be substituted when it loses its absorption power due to the wear and furthermore said insole 20 can be used successfully even separately from the integral system previously described. This means that optionally the insole 20 can be incorporated into a conventional lady's or man's shoe for the comfort of the wearer.

The same consideration applies to the heal of this system because said heel can be incorporated into the traditional high heeled shoe with a minimum of modifications to the conventional structure of the common shoe.

Although the invention has been described in its preferred embodiment, it will be evident that some variations can be deduced from the described and illustrated concepts, which should be considered obvious in the light of the foregoing and within the reach of the spirit of the integral system herein described.

I claim:

1. An integral system for the manufacture of shoes, comprising:

a) a shoemaker's last conformed anatomically;

b) a padded sole member having ventilation means;

c) an insole assembly for a shoe, which is disposed below said padded sole member with which it is fixed by insertion, said sole assembly comprising: a baricentric oversole with hollow sections predefined in the plantar and tarsal regions, in which hollow sections some lower portions, of complementary design, of said padded sole member are inserted; an intersole placed below said baricentric oversole having flexure lines below the area where the foot bends to make a step; an interior band metatarsal disposed below said intersole to provide rigidity and structure to the metatarsal arch and bridge of the wearer; and a reinforcing web under the band to reinforce the elements comprising said sole assembly;

d) an antiskid damping sole disposed below said sole assembly, said damping sole comprising a sole element with a hollow section, an elastometric element with multiple holes, and a piece having an antiskid lower surface and an upper surface on which a plurality of elements upwardly extend to engage with said holes in the elastomeric element; said piece configured for insertion into the hollow section of the sole element and e) a heel having means for dampening in the heel zone the impact of the step when walking.

2. The integral system of claim 1, wherein said ventilation means consists of multiple through holes provided in plantar, tarsal and metatarsal regions in said sole member, and a plurality of channels in air flow communication with said holes to form jointly air circulation paths to keep the wearer's foot dry.

3. The integral system of claim 1, wherein said padded sole member has thickened lower portions located on the plantar and tarsal regions thereof.

4. The integral system of claim 1, wherein said padded sole member further includes a flange on the tarsal region adapted to conform anatomically to the wearer's heel.

5. The integral system of claim 1, wherein said padded sole member is made of an integral piece.

6. The integral system of claim 1, wherein said padded sole member is replaceable when it loses its elastic characteristics.

7. The integral system of claim 1, further including an anatomically shaped overinsole attached firmly above the padded sole member.

8. The integral system of claim 7, wherein the overinsole includes an antibacterial liner and biomagnetics sensing elements.

9. The integral system of claim 1, wherein said heel comprises a) a heel body having a bore extending longitudinally throughout said heel body, first and second recesses provided at the lower and upper ends, respectively, of said heel body; and a hollow, elongated structural reinforcement of resistant material covering the wall of said bore; and b) a dampening cap assembly comprising:

i) a removable cap element with an insertion rod fixed firmly on one end of said cap element; said rod is insertable in said bore through a lower opening in said heel body so that a threaded opposite end of said rod protrudes up to the second recess in said heel body for threaded connection with a fastening element;

ii) a protection cap secured firmly by adjusting it to the lower end of the heel body, said cap having a groove and a hole in register with the heel body bore;

iii) a piece of elastomeric material with a hole, said rod being adapted to mate with the hole until it rests in the removable cap, said elastomeric piece and the removable cap being sized so that the elastomeric piece is completely housed in said cap; said removable cap is partially inserted in first recess of the protection cap; and iv) an annular gasket element being sized to fit around the insertion rod to stay placed between the point of contact of the protection cap with the bottom of said first recess.

10. The integral system of claim 9, wherein the protection cap further has a journal to be inserted tightly in the first recess of the heel bore to fix said cap in the heel body.

11. The integral system of claim 9, wherein the cap element is replaceable when said element wears out with the use.

12. The integral system of claim 9, wherein the elastomeric piece is replaceable when it loses its elastic properties due to its use.

13. The integral system of claim 1, wherein the padded insole comprises an integral piece of elastomeric material including an air ventilation system comprising a plurality of holes passing through the elastomeric piece in the plantar, tarsal and metatarsal regions, and a plurality of channels in flow communication with said holes to promote jointly the circulation of air all over the foot's sole.

14. The elastomeric insole of claim 13, further including padding parts thickened on the lower surface of the same or just on the tarsal and plantar zones thereof.

15. The integral system of claim 13, further including a flanged portion in the tarsal region to fit to the user's heel.

16. The integral system of claim 13, wherein the insole is made of one piece.

17. The integral system of claim 13, wherein the insole can be replaced when it loses its elastomeric characteristics.

18. A heel for a women's high heeled shoe, including a system to dampen the impact caused when walking, said heel comprising:

a) a heel body with a bore extending longitudinally through it and first and second recesses located at the ends of said bore; said heel body further comprises a hollow structural reinforcement made of resistant material, which covers the wall of said bore; and b) a dampening cap assembly comprising:

i) a removable cap with an insertion rod fixed firmly on one of its ends to said cap, the opposed end of said rod is threaded and is inserted in the heel body bore through the lower end of said heel, the threaded rod end protruding up to the second recess of the heel body to be grasped by a grasping element;

ii) a grasping element connected to said threaded rod end to hold the removable cap inserted in said heel body;

iii) a protection cap firmly adhered by engagement at the lower end of the heel body, said cap having a recess and a hole being in register with the heel bore;

iv) an elastomeric piece having a hole, said piece adapted to mate with the rod such that said piece remains in contact with the removable cap; said elastomeric piece and said removable cap are sized in such a manner that the elastomeric piece is totally lodged in said first recess of the protection cap, while the removable cap is housed, at least in part, in said first recess; and v) an annular gasket inserted around the insertion rod to be placed between the contact point of the protection cap with the bottom of the first recess of the heel bore.

19. The integral system of claim 18, wherein the protection cap further includes a journal to be inserted in said first recess of the heel body to secure said cap in this body.

20. The integral system of claim 18, wherein the cap is replaceable when said element wears out with use.

21. The integral system of claim 18, wherein the elastomeric piece is replaceable when it looses its elastic characteristics due to its use.

* * * * *